US008146334B2

(12) United States Patent
Fresnel

(10) Patent No.: US 8,146,334 B2
(45) Date of Patent: Apr. 3, 2012

(54) DEVICE FOR PLACING SLEEVES ON TRAVELING ARTICLES

(75) Inventor: Eric Fresnel, Paris (FR)

(73) Assignee: Sleever International Compagny, Morangis (FR)

( * ) Notice: Subject to any disclaimer, the term of this patent is extended or adjusted under 35 U.S.C. 154(b) by 290 days.

(21) Appl. No.: 12/503,874

(22) Filed: Jul. 16, 2009

(65) Prior Publication Data

US 2010/0037556 A1 Feb. 18, 2010

(30) Foreign Application Priority Data

Aug. 14, 2008 (FR) ..... 08 04599

(51) Int. Cl.
*B65B 11/02* (2006.01)

(52) U.S. Cl. ..... 53/585; 53/389.2; 53/399; 53/557

(58) Field of Classification Search ..... 53/585, 53/389.2, 389.3, 389.4, 399, 557
See application file for complete search history.

(56) References Cited

U.S. PATENT DOCUMENTS

| | | | | |
|---|---|---|---|---|
| 4,179,863 | A | 12/1979 | Fresnel | |
| 4,744,206 | A * | 5/1988 | Winter | 53/585 |
| 4,765,121 | A * | 8/1988 | Konstantin et al. | 53/442 |
| 4,910,941 | A * | 3/1990 | Nagano et al. | 53/291 |
| 4,922,683 | A * | 5/1990 | Connolly | 53/296 |
| 5,566,527 | A * | 10/1996 | Drewitz | 53/295 |
| 5,737,900 | A * | 4/1998 | Konstantin et al. | 53/295 |
| 6,070,399 | A * | 6/2000 | Huang et al. | 53/585 |
| 6,684,599 | B1 * | 2/2004 | Fresnel | 53/64 |
| 6,996,954 | B1 * | 2/2006 | Farley et al. | 53/459 |
| 7,024,841 | B2 * | 4/2006 | Kramer et al. | 53/585 |
| 7,343,842 | B2 * | 3/2008 | Chen | 83/597 |
| 7,398,811 | B1 * | 7/2008 | Duncan et al. | 156/392 |
| 7,765,842 | B2 * | 8/2010 | Boltshauser | 72/58 |
| 7,937,910 | B2 * | 5/2011 | Jaconelli et al. | 53/441 |
| 2004/0016207 | A1 * | 1/2004 | Lortz | 53/397 |
| 2004/0128958 | A1 * | 7/2004 | Kramer et al. | 53/567 |
| 2010/0162660 | A1 * | 7/2010 | Jaconelli et al. | 53/399 |

FOREIGN PATENT DOCUMENTS

| | | | |
|---|---|---|---|
| EP | 0 000 851 | A1 | 2/1979 |
| EP | 0 109 105 | A1 | 5/1984 |
| WO | 99/59871 | A1 | 11/1999 |

OTHER PUBLICATIONS

French Search Report for Serial No. 0804599 dated Mar. 18, 2009.

* cited by examiner

*Primary Examiner* — Hemant M Desai
(74) *Attorney, Agent, or Firm* — McCormick, Paulding & Huber LLP

(57) ABSTRACT

The invention relates to a device for placing sleeves on traveling articles, said sleeves being cut from a continuous sheath passing over a sheath-opening shaper, first outer wheels serving to advance the sheath along the shaper, and second outer wheels being provided downstream from cutter means for the purpose of ejecting the cut-off sheath segment, said wheels being driven in rotation by associated electric motors controlled synchronously by a virtual-shaft common electronic programmer. In accordance with the invention, the programmer is arranged to determine a continuous profile of speed variation for the associated electric motors, said profiles being bell-shaped and having a common end segment in which the profiles coincide, this corresponding to the motors having identical speeds, the length of the common end segment being selected so that the sheath is advanced beyond the point of tangential contact with the second wheels so that said sheath is pinched by said second wheels prior to being held stationary for the cutting and ejection pass.

8 Claims, 2 Drawing Sheets

Fig.3
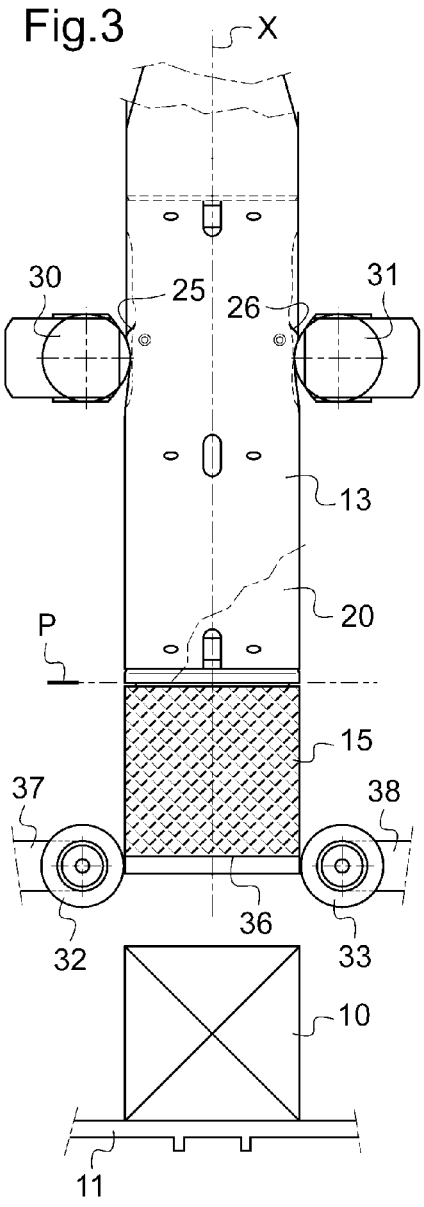
Fig.4
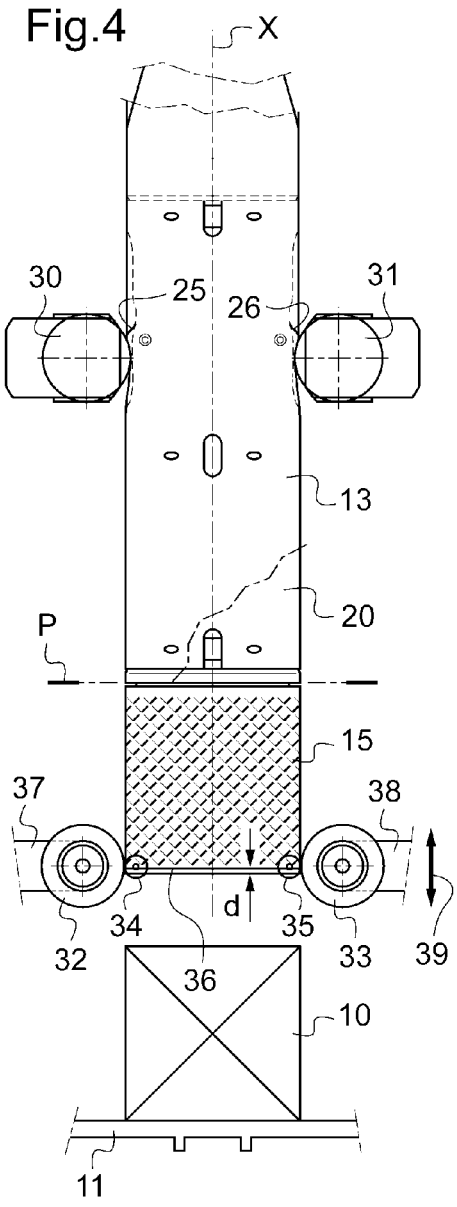
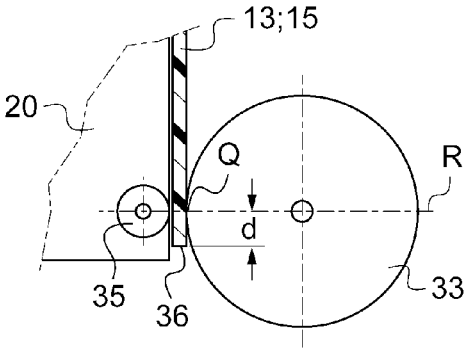
Fig.5

DEVICE FOR PLACING SLEEVES ON TRAVELING ARTICLES

CROSS REFERENCE TO RELATED APPLICATION

Applicant hereby claims foreign priority benefits under U.S.C. §119 from French Patent Application No. 08 04599 filed on Aug. 14, 2008, the contents of which are incorporated by reference herein.

FIELD OF THE INVENTION

The present invention relates to placing sleeves, in particular heat-shrink sleeves, on traveling articles, the sleeve-covered articles then passing through a shrinking oven.

BACKGROUND OF THE INVENTION

To place heat-shrink sleeves on traveling articles, it is conventional to use a technique whereby the sleeves are cut from a continuous sheath that passes over a sheath-opening shaper, which shaper is held floating by co-operation between outer wheels and backing wheels of parallel axes carried by the shaper, which outer wheels serve to cause the sheath to advance along the shaper (which is generally vertical) up to and beyond cutter means. Other wheels are generally provided downstream from the cutter means to eject the segment of sheath that has been cut off onto the article that travels to a position vertically beneath the shaper.

Thus, in most of the techniques used, there are first outer wheels for advancing the sheath over the shaper, and second outer wheels serving to eject the cut-off sheath segments onto the articles in question. All of the outer wheels are naturally motor-driven, and the way they are motor-driven has given rise to various types of arrangement.

Thus, proposals have been made for the motor drive of the first and second wheels to be completely independent so as to enable the second wheels to turn much faster than the first, thereby causing the cut-off sheath segment to drop vertically more quickly onto the article in question. That approach is illustrated in document EP-A-0 109 105. In another approach, the rotary drive of the first and second wheels is synchronized, as shown in document EP-A-0 000 851.

Nevertheless, it has been found that the above-mentioned techniques impose limits in terms of rates of throughput, since when high rates are reached, it is found that the sheaths are frequently poorly positioned on the articles, particularly when they constitute sleeves of considerable height.

More recently, an important advance has been made by a technique implementing synchronous control over the electric motors concerned by means of a common electronic programmer arranged to determine a continuous speed variation profile so as to control the ejection of each sheath segment, said programmer including at least one control card that co-operates with an adjacent coder mounted at the end of a shaft that is driven in rotation by a central motor and gearbox unit. This is illustrated in document WO-A-99/59871 in the name of the Applicant. According to that technique, the synchronization makes it possible to envisage rates of throughput that are higher than before, and this is possible with sleeves of a diameter that is hardly any greater than the maximum diameter of the articles.

Nevertheless, there is an increasing demand for ever higher rates of throughput, commonly reaching values of 300 to 600 strokes per minute.

It is then preferable to use machines that are further improved, abandoning the system whereby articles advance stepwise, and also abandoning the coder system mounted at the end of a shaft driven in rotation by a central motor and gearbox unit (as described in above-mentioned document WO-A-99/59871), and instead to make use of a virtual shaft common electronic programmer for controlling all of the electric motors, with the instruction for ejecting a cut-off sheath segment being given by a cell when the traveling article goes past it.

In parallel with this search for very high rates of throughput, there is also a trend to use sheaths made of heat-shrink film that is of ever smaller thickness. As an indication, conventional techniques used to use heat-shrink films with thickness of the order of 50 micrometers (μm), whereas nowadays it is desired to use films of heat-shrink plastics material that is of smaller thickness, i.e. possibly as little as 25 μm, and that is also of smaller density.

The two above-mentioned requirements thus considerably complicate organizing sleeve-placing devices, and mention can be made of one type of technical problem that is becoming more and more awkward, and this relates to positioning the sheath on the shaper at the time it is being held stationary for the cutting and ejection pass.

The slightest variation in the position of the downstream portion of the sheath on the shaper, i.e. the portion that is to constitute the segment for ejection after the cutting pass, has the effect of giving greatly-varying heights to the cut-off sheath segment (where the height of a segment is measured along the direction of the generator lines of said segment).

In above-mentioned document WO-A-99/59871, proposals are made to arrange the control of the electric motors associated with the first wheels for advancing the sheath and with the second wheels for ejecting the cut-off segment in such a manner that the continuous profiles of speed variation for said motors are bell-shaped, rather than being square-wave-shaped was the previous practice. Nevertheless, it has been found that by causing such a device to operate at very high rates of throughput, the above-mentioned bell-shaped curves give rise to problems in terms of accuracy at the end of the advance/eject cycle, even when adopting a virtual-shaft common electronic programmer.

This lack of accuracy is also to be found when the sleeve-placing device is stopped, prior to a new period of operation, such that the position of the sheath is de facto inaccurate when operation restarts.

A direct consequence of this is that the axial position of the sheath on the shaper is never defined with complete accuracy. In practice, the free edge of the sheath is held stationary a little upstream from the second wheels for ejection and it is the following thrust from the sheath that brings this free edge into contact with the ejection wheels for the ejection process. The height of the segment is never accurately constant and it is never possible to completely eliminate the risk of the sheath slipping on the shaper at the time it is being held stationary for the cutting and ejection pass.

SUMMARY OF THE INVENTION

An object of the invention is to devise a device for placing sleeves on traveling articles that does not present the above-mentioned drawbacks and limitations concerning the above-explained technical problem about positioning the sheath on the shaper at the time the sheath is being held stationary for the cutting and ejection pass, and also when the device itself is stopped.

Another object of the invention is to propose a sleeve-placing device that is arranged to enable very high rates of throughput, possibly as high as 600 strokes per minute, and even when using continuous sheaths made from films of small thickness, e.g. possibly as thin as 25 micrometers (μm), and of low density, in particular of relative density less than 1.

The above-described problem is solved in accordance with the invention by a device for placing sleeves on traveling articles, said sleeves being cut from a continuous sheath passing over a sheath-opening shaper, which shaper is held floating between first outer wheels and backing wheels having parallel axes carried by said shaper, said first wheels serving to cause the sheath to advance along the shaper up to and beyond cutter means, second outer wheels being provided downstream from the cutter means to eject each cut-off sheath segment onto an article located vertically below the shaper as a result of said article passing a cell, said first and second wheels being driven in rotation by associated electric motors that are controlled synchronously by a virtual-shaft common electronic programmer, said sleeve-placing device being remarkable in that the electronic programmer is arranged to determine a continuous profile for varying the speeds of the above-mentioned associated electric motors, said continuous profiles being bell-shaped and having a common end segment in which the profiles coincide, thus corresponding to said associated electric motors having speeds that are identical, the length of said common end segment being selected so that the sheath is advanced beyond the point of tangential contact with the second wheels, in such a manner that said sheath is pinched by said second wheels prior to being held stationary for the cutting and ejection pass.

Thus, the above-specified characteristics make it possible to guarantee that the free end of the sheath is always properly pinched by the second wheels for ejection of the cut-off segments prior to being held stationary for the cutting and ejection pass. Such an advance beyond the point of tangential contact guarantees that the sheath is stopped with positive engagement, thereby de facto eliminating any risk of the sheath sliding on the shaper, and thus contributing to obtaining a completely regular cut edge. It is easy to understand that the process of ejecting the cut-off sheath segment can start instantly, without any dead time, because of the above-mentioned positive engagement.

Preferably, the virtual-shaft common electronic programmer includes at least one controlling electronic card associated with the electric motors for driving the wheels, which card is arranged in such a manner that the length of the common end segment that corresponds to the variations in the speeds of the electric motors as a function of the angular positions of their respective virtual shafts, is directly representative of a predetermined distance between the point of tangential contact and the free edge of the sheath at the time said sheath is being held stationary for the cutting and ejection pass. Advantageously, the predetermined distance is then also established when the sleeve-placing device is stopped, and remains frozen throughout the period said device is not in operation.

For example, provision can be made for the above-specified distance between the point of tangential contact and the free edge of the sheath to lie essentially in the range 0.5 millimeters (mm) to 3 mm, while preferably being close to 1 mm.

Provision may advantageously be made for the second wheels to be mounted on respective supports that are adjustable in position in the direction of the axis of the shaper, so as to adjust the distance between the point of tangential contact and the free edge of the sheath at the time said sheath is being held stationary for the cutting and ejection pass.

In a particular embodiment, the shaper has a smooth-walled downstream end, and the sheath is then pinched, at the time said sheath is being held stationary for the cutting and ejection pass, between the second wheels and said smooth wall.

In a variant, provision can be made for the shaper to be fitted at its downstream end with backing wheels, and the sheath is then pinched, at the time said sheath is being held stationary for the cutting and ejection pass, between the second wheels and the associated backing wheels.

Advantageously, the second wheels and the associated backing wheels then have axes that slide in a common plane perpendicular to the axis of the shaper.

Other characteristics and advantages of the invention appear more clearly in the light of the following description and the accompanying drawings, relating to one particular embodiment.

BRIEF DESCRIPTION OF THE DRAWINGS

Reference is made to the figures of the accompanying drawings, in which:

FIG. 3 is a fragmentary elevation view showing the situation at the time the sheath is being held stationary, immediately after the cutting pass and prior to ejection of the cut-off sheath segment, shown here with a sleeve-placing device of traditional type, the figure showing in particular the position of said cut-off sheath segment for ejection relative to the ejector wheels;

FIG. 4 is a view analogous to the view of FIG. 3, but showing a sleeve-placing device that implements the invention, shown in the same situation with the new position for the cut-off sheath segment that is to be ejected, its downstream edge now being gripped by the ejector wheels, this stationary position also being the position that applies when the sleeve-placing device is stopped; and FIG. 5 is a fragmentary view on a larger scale showing the above-mentioned pinching phenomenon.

DETAILED DESCRIPTION OF THE PREFERRED EMBODIMENT

Figure 1:
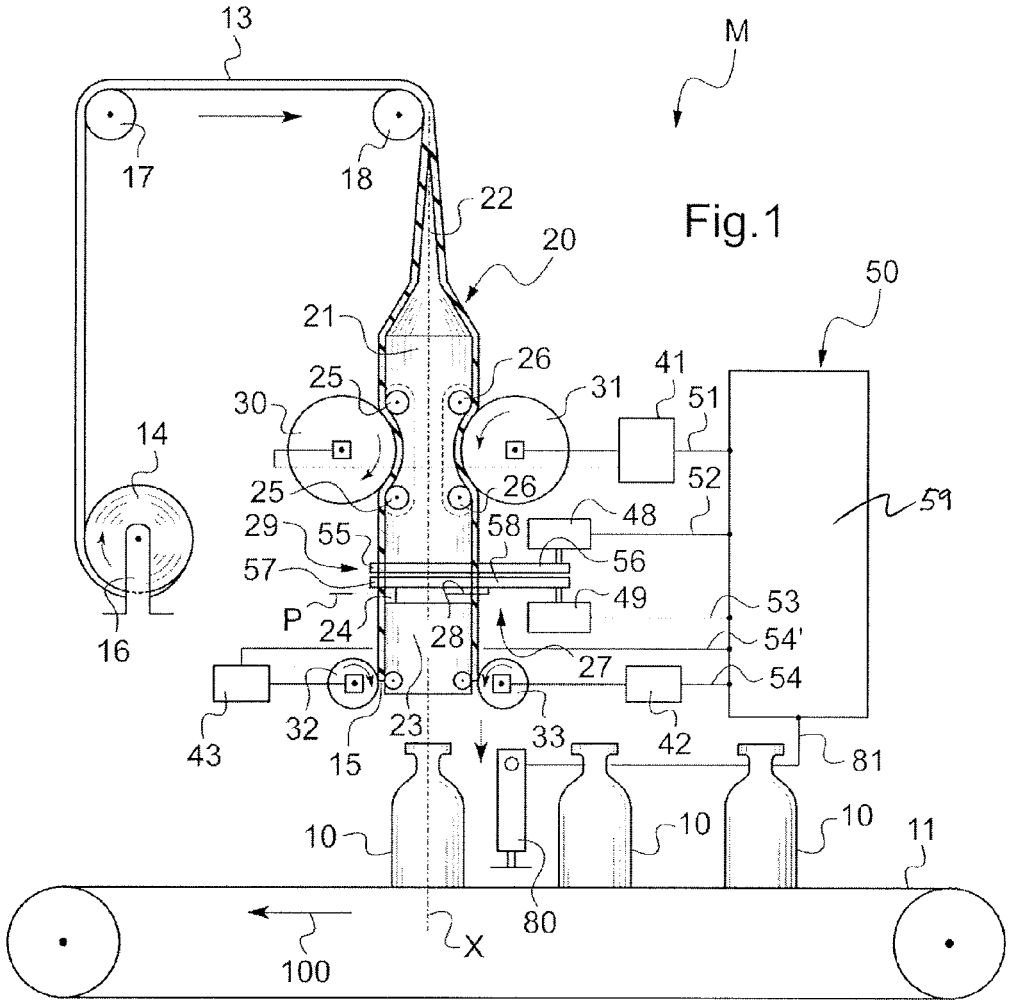
FIG. 1 shows a sleeve-placing device in accordance with the invention, with the various means for imparting rotary drive to wheels that co-operate with the sheath passing over the shaper, here of vertical axis, being represented symbolically, and with a cut-off segment of sheath.

In FIG. 1, there can be seen a sleeve-placing machine referenced M, serving to place sleeves on traveling articles, and arranged in accordance with the invention.

The sleeve-placing machine M has a certain number of points in common with the sleeve-placing machine described in above-mentioned document WO-A-99/59871 in the name of the Applicant. These elements in common are therefore described briefly, however reference can be made to the above-mentioned document for more ample details.

The articles 10, here shown in the form of bottles, are traveling on a conveyor belt 11 in a direction referenced 100, with the travel of the conveyor belt being driven by associated means that are not shown.

A flat sheath of heat-shrink plastics material 13 is delivered from a reel 14 mounted to rotate on a portion of a structure 16, said sheath passing over two deflector rollers 17 and 18 to be brought over a shaper 20 for opening the sheath. The sheath-opening shaper 20, here having a vertical axis X, comprises an upstream central portion 21 surmounted by a flat portion 22 so as to open progressively the continuous sheath 13 arriving on said shaper. The sheath-opening shaper 20 also has a downstream portion 23 that extends the upstream central portion 21, with a groove 24 being formed between them.

Cutter means 27 including at least one moving blade 28 are carried by a rotary support 29 arranged level with the groove 24 for cutting the sheath in response to a given command instruction, cutting taking place circularly in a plane P that is perpendicular to the axis X of the shaper, i.e. specifically essentially horizontal.

The shaper 20 is of the floating type, being held by co-operation between first outer wheels 30 and 31 and backing wheels 25 and 26 of parallel axes that are carried by said shaper.

The continuous sheath 13 thus opens progressively on the upstream portion 21 of the shaper 20 and passes between the wheel 30 and the backing wheels 25, and also between the wheel 31 and the backing wheels 26, respectively, the wheels 30 and 31 thus serving both to provide a floating support for the shaper 20, and on being motor-driven, to perform a function of advancing the continuous sheath 13 along said shaper.

Second outer wheels 32 and 33 are provided downstream from the cutter means 27 for ejecting each cut-off segment of sheath, referenced 15, onto an article 10 located vertically below the shaper 20 as a result of said article moving past a cell 80.

An electric motor 41 is shown diagrammatically that is used for driving the pair of sheath-advance wheels 30 and 31, and two electric motors 42 and 43 are shown for driving the wheels 32, 33 that eject the cut-off segments of sheath.

The cutter means 27 are carried by a rotary support 29 that is made up of two superposed rings 55 and 57 that are driven in rotation, with the difference in their speeds of rotation acting via a special cam system that is described in greater detail below to cause the cutter blade(s) 28 to pivot in alternation between a retracted position and a cutting position. The two superposed rings 55 and 57 are driven via belts 56 and 58 by two electric motors 48 and 49.

The above-mentioned electric motors 41, 42, 43, 48, and 49 are connected via respective associated lines 51, 52, 53, 54, and 54' and by a common electronic programmer 50 to a virtual shaft. The cell 80 that sees each traveling article 10 go past is connected by a line 81 to the common electronic programmer 50 specifically for the purpose of transmitting the signal that authorizes the motors 42 and 43 that are associated with ejecting the cut-off segment of the sheath onto the article 10 located vertically below the shaper 20 to be set into operation. General synchronization is provided by the virtual-shaft common electronic programmer 50 that includes at least one electronic control card 59 having multiple commands that is connected to the above-mentioned command lines 51, 52, 53, 54, and 54'.

The common electronic programmer 50 is arranged in particular to determine continuous profiles for variation in the speeds of the electric motors 41, 42, and 43 associated with driving the first wheels 30 and 31 and the second wheels 32 and 33 in rotation. These continuous profiles are different from the profiles shown in above-mentioned document WO-A-99/59871, and they are shown here in FIG. 2, which plots variations in the speed v as a function of the angular positions q of the associated virtual shafts.

Figure 2:
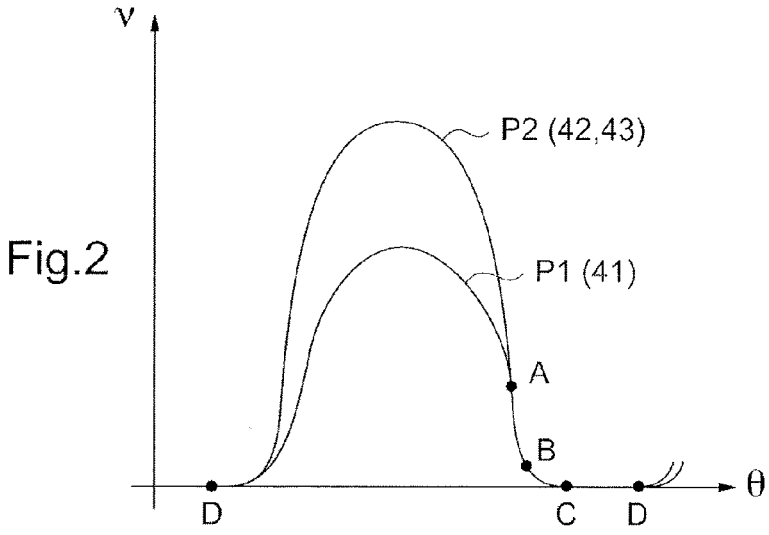
FIG. 2 is a diagram showing the profiles of variations in the speeds of rotation of the sheath advance wheels and of the ejector wheels, as a function of the angular positions of respective virtual shafts of the associated electric motors, these profiles being bell-shaped with a common end segment in which the profiles coincide, in accordance with an essential characteristic of the invention.

As shown in FIG. 2, the continuous profiles, referenced P1 (for electric motor 41) and P2 (for the electric motors 42 and 43) are bell-shaped. The advantages of such a bell-shaped profile are set out in detail in above-mentioned document WO-A-99/59871, which advantages apply in particular relative to earlier variation profiles that were of squarewave shape.

Nevertheless, unlike the profiles shown in the above-mentioned documents, these continuous profiles P1 and P2 include a common end segment in which the profiles coincide, which corresponds to the associated electric motors having speeds that are identical. Thus, the two bell-shaped profiles P1 and P2 meet at a point A, and from that point, the two profiles coincide all the way to a point C where speed is zero. This common end segment AC passes via a point B that corresponds to the speed v slowing down. The precise location of the point A is not known with any certainty, but the length of the common end segment is sufficient for the existence of such a segment to be guaranteed, and thus to guarantee the advantages that stem therefrom.

The common segment AC, which corresponds to identical speeds for the associated electric motors, thus presents a specific length that is selected so that the sheath 13 is advanced beyond the point Q of tangential contact with the second wheels 32, 33 (more clearly visible in FIG. 5) so that said sheath 13 is pinched by said second wheels prior to being held stationary for the cutting and ejection pass.

This additional advance is essential in practice since it guarantees that the sheath is stopped against the shaper with positive engagement. Thereafter, when the wheels advance the sheath 30, 31 and the ejector wheels 32, 33 are stopped for a short instant during the cutting and ejection pass, there is no danger of the sheath 13 slipping on the shaper 20, and it is ensured that ejection will start properly and instantaneously when the ejector wheels act on the cut-off sheath segment 15.

This also applies when the sleeve-placing device is stopped, and throughout the period said device is not in operation, with the pinched sheath remaining very accurately in position. This frozen position enables operation to be restarted immediately without any loss of accuracy.

FIG. 3 shows a situation as encountered with a conventional technique, for example that described in above-mentioned document WO-A-99/59871.

In this figure, there can be seen the plane P corresponding to the cutting plane, which plane is perpendicular to the axis X of the shaper 20, the sheath advance wheels 30 and 31, and the ejector wheels 32 and 33 that are carried by associated supports 37 and 38. The cut-off sheath segment 15, shown shaded for greater convenience, is then in a position such that its downstream free end edge 36 is generally above the point of tangential contact with the ejector wheels 32, 33. This is the ill-inaccurate situation referred to in the introductory portion of the present description.

FIG. 4 is analogous to FIG. 3 and uses the same references, showing the situation at an identical moment but in a sleeve-placing device in accordance with the invention.

The detail view of FIG. 5 on a larger scale shows more clearly the additional advance imparted to the sheath 13 in order to guarantee that said sheath is usefully pinched by the ejector wheels 32 and 33.

FIG. 5 shows the downstream end zone of the sheath 13 where it is pinched by the ejector wheel 33, pinching being such that the free end edge 36 of said sheath has advanced through a predetermined distance referenced d beyond the point Q of tangential contact. Naturally, the same situation arises with the other ejector wheel 32.

As can be understood, the length of the above-mentioned common segment AC, which corresponds to the variations in the speeds of the electric motors 41, 42, and 43 as a function of the angular position q of their respective virtual shafts, is directly representative of the above-mentioned predetermined distance d between the point Q of tangential contact and the free edge 36 of the sheath 13 at the time the sheath is being held stationary for the cutting and ejection pass.

As an indication, the predetermined distance d between the point Q of tangential contact and the free edge 36 of the sheath 13 lies essentially in the range 0.5 mm to 3 mm, being preferably close to 1 mm.

In FIG. 4, a double-headed arrow 39 also represents the fact that the supports 37, 38 for the wheels 32, 33 are adjustable in position along the direction of the axis X of the shaper 20, specifically in the vertical direction in this example. This height adjustment thus enables the above-mentioned distance d to be adjusted and makes it possible to adapt to a possible change in the height of the sheath segment in association with other traveling articles.

The shaper 20 may have a smooth-walled downstream end, in which case the sheath 13 is pinched between the second wheels 32, 33 and said smooth wall. Nevertheless, in particular given the very high rates of throughput mentioned above, it is preferable to provide backing wheels 34, 35 facing the ejector wheels 32, 33, as shown in FIG. 4. Under such circumstances, the sheath 13 is pinched between the second wheels 32, 33 and the associated backing wheels 34, 35 that are carried by the shaper 20.

Although not absolutely essential, it is advantageous to make provision, as can be seen more clearly in FIG. 5, for the second wheels 32, 33 and the associated backing wheels 34, 35 to have axes that lie in a common plane R that is perpendicular to the axis X of the shaper 20.

Finally, returning to FIG. 2, it can be seen that the common end segment AC of the two bell-shaped profiles P1 and P2 that passes through the point B is continued at a zero speed (point C) as far as a point D, which point D corresponds to beginning the following cycle.

This enables a device for placing sleeves on traveling articles to be provided that constitutes a significant improvement over the prior device of document WO-A-99/59871, by improving the accuracy with which the sheath is positioned on the shaper.

The sleeve-placing machine enables very high rates of throughput to be used, e.g. 600 strokes per minute, and makes this possible with sheaths made from a film that is of small thickness, e.g. 25 μm, and of low density, e.g. of relative density less than 1.

The invention is not limited to the embodiment described above, but on the contrary covers any variant using equivalent means to reproduce the essential characteristics specified above.

What is claimed is:

1. A device for placing sleeves on traveling articles, said sleeves being cut from a continuous sheath passing over a sheath-opening shaper;

which shaper is held floating between first outer wheels and backing wheels having parallel axes carried by said shaper;

said first wheels serving to cause the sheath to advance along the shaper up to and beyond cutter means;

second outer wheels being provided downstream from the cutter means to eject each cut-off sheath segment onto an article located vertically below the shaper as a result of said article passing a cell;

said first wheel is rotatably driven by a first electric motor and said second wheel is rotatably driven by a second electric motor, wherein the first and second electric motors are controlled synchronously by a virtual-shaft common electronic programmer;

wherein the electronic programmer varies the speeds of the first and second electric motors in a accordance with a first and second continuous profile, respectively;

said first and second continuous profiles being bell-shaped curves that define the speed of the first and second electric motors, respectively, and having a common end segment in which the profiles coincide, which corresponds to the speeds of the of the first and second electric motors being identical;

wherein the length of said common end segment is selected so that the sheath is advanced beyond the point of tangential contact with the second wheels in such a manner that said sheath is pinched by said second wheels prior to being held stationary for the cutting and ejection pass.

2. The sleeve-placing device according to claim 1, wherein the virtual-shaft common electronic programmer includes at least one controlling electronic card associated with the first and second electric motors for driving the first and second wheels, the controlling electronic card being programmed such that the length of the common end segment that corresponds to the variations in the speeds of the first and second electric motors as a function of the angular positions of their respective virtual shafts, is directly representative of a predetermined distance between the point of tangential contact and the free edge of the sheath at the time said sheath is being held stationary for the cutting and ejection pass.

3. The sleeve-placing device according to claim 2, wherein the predetermined distance is also established when the sleeve-placing device is stopped, and remains frozen throughout the period said device is not in operation.

4. The sleeve-placing device according to claim 2, wherein the predetermined distance between the point of tangential contact and the free edge of the sheath lies essentially in the range 0.5 mm to 3 mm, and is preferably close to 1 mm.

5. The sleeve-placing device according to claim 1, wherein the second wheels are mounted on respective supports that are adjustable in position in the direction of the axis of the shaper, so as to adjust the distance between the point of tangential contact and the free edge of the sheath at the time said sheath is being held stationary for the cutting and ejection pass.

6. The sleeve-placing device according to claim 1, wherein the shaper has a smooth-walled downstream end, and the sheath is then pinched, at the time said sheath is being held stationary for the cutting and ejection pass, between the second wheels and said smooth wall.

7. The sleeve-placing device according to claim 1, wherein the shaper is fitted at its downstream end with backing wheels, and the sheath is then pinched, at the time said sheath is being held stationary for the cutting and ejection pass, between the second wheels and the associated backing wheels.

8. The sleeve-placing device according to claim 7, wherein the second wheels and the associated backing wheels have axes that slide in a common plane perpendicular to the axis of the shaper.

* * * * *